US011409245B2

(12) United States Patent
Winkler

(10) Patent No.: US 11,409,245 B2
(45) Date of Patent: Aug. 9, 2022

(54) ANTI SHOCK PROTECTION FOR A RESONATOR MECHANISM WITH A ROTARY FLEXURE BEARING

(71) Applicant: ETA SA Manufacture Horlogere Suisse, Grenchen (CH)

(72) Inventor: Pascal Winkler, St-Blaise (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 476 days.

(21) Appl. No.: 16/654,262

(22) Filed: Oct. 16, 2019

(65) Prior Publication Data

US 2020/0150595 A1 May 14, 2020

(30) Foreign Application Priority Data

Nov. 8, 2018 (EP) ..... 18205260

(51) Int. Cl.

| | |
|---|---|
| ***G04B 17/04*** | (2006.01) |
| ***G04B 31/02*** | (2006.01) |
| ***G04B 17/06*** | (2006.01) |

(52) U.S. Cl.

CPC ..... *G04B 31/02* (2013.01); *G04B 17/045* (2013.01); *G04B 17/063* (2013.01)

(58) Field of Classification Search

CPC .... G04B 31/02; G04B 17/045; G04B 17/063; G04B 17/04

See application file for complete search history.

(56) References Cited

U.S. PATENT DOCUMENTS

| | | | | |
|---|---|---|---|---|
| 9,323,222 | B2 * | 4/2016 | Stranczl | G04B 31/06 |
| 9,477,205 | B2 * | 10/2016 | Born | G04C 3/101 |
| 9,958,831 | B2 * | 5/2018 | Di Domenico | G04B 15/14 |
| 9,971,303 | B2 * | 5/2018 | Helfer | G04B 17/10 |

(Continued)

FOREIGN PATENT DOCUMENTS

| | | |
|---|---|---|
| CN | 105467812 A | 4/2016 |
| CN | 105717777 A | 6/2016 |

(Continued)

OTHER PUBLICATIONS

Japanese Office Action dated Dec. 1, 2020 in Japanese Patent Application No. 2019-195910 (with English translation), 4 pages.

(Continued)

*Primary Examiner* — Sean Kayes

(74) *Attorney, Agent, or Firm* — Oblon, McClelland, Maier & Neustadt, L.L.P.

(57) ABSTRACT

A timepiece resonator mechanism includes a structure carrying, via a flexible suspension system, an anchor unit to which is suspended an inertia element oscillating about a pivot axis extending in a first direction Z, in a first rotational degree of freedom RZ, under the action of the return forces of a flexure pivot including longitudinal elastic strips each fixed to this inertia element and to this anchor unit. The flexible suspension system includes, between the anchor unit and a first intermediate mass directly or indirectly fixed to the structure, a transverse translation table with a flexure bearing and including transverse strips or transverse flexible shafts which are rectilinear and extend in this second direction X orthogonal to the first direction Z and symmetrically around a transverse axis crossing this pivot axis.

21 Claims, 4 Drawing Sheets

(56) References Cited

U.S. PATENT DOCUMENTS

| | | | | |
|---|---|---|---|---|
| 10,585,398 | B2 * | 3/2020 | Henein | G04B 15/14 |
| 2016/0179058 | A1 | 6/2016 | Born et al. | |
| 2018/0136609 | A1 | 5/2018 | Winkler et al. | |

FOREIGN PATENT DOCUMENTS

| | | | |
|---|---|---|---|
| CN | 107065493 | A | 8/2017 |
| CN | 107957672 | A | 4/2018 |
| CN | 108073065 | A | 5/2018 |
| EP | 3 035 127 | A1 | 6/2016 |
| EP | 3 299 905 | A1 | 3/2018 |
| EP | 3 324 247 | A1 | 5/2018 |

OTHER PUBLICATIONS

Combined Chinese Office Action and Search Report dated Dec. 11, 2020, in Chinese Patent Application No. 201911081303.X (with English translation), 7 pages.

European Search Report dated Apr. 18, 2019 in European Application 18205260.5, filed on Nov. 8, 2018 (with English Translation of Categories of Cited Documents & Written Opinion).

* cited by examiner

ANTI SHOCK PROTECTION FOR A RESONATOR MECHANISM WITH A ROTARY FLEXURE BEARING

CROSS-REFERENCE TO RELATED APPLICATION

This application claims priority to European Patent Application No. 18205260.5 filed on Nov. 8, 2018, the entire disclosure of which is hereby incorporated herein by reference.

FIELD OF THE INVENTION

The invention concerns a timepiece resonator mechanism comprising a structure and an anchor unit to which is suspended at least one inertia element arranged to oscillate with a first rotational degree of freedom RZ about a pivot axis extending in a first direction Z, said inertia element being subjected to return forces exerted by a flexure pivot comprising a plurality of substantially longitudinal elastic strips, each fixed, at a first end to said anchor unit, and at a second end to said inertia element, each said elastic strip being deformable essentially in a plane XY perpendicular to said first direction Z.

The invention also concerns a timepiece oscillator including at least one such resonator mechanism.

The invention also concerns a timepiece movement including at least one such oscillator and/or one such resonator mechanism.

The invention also concerns a watch including such a timepiece movement and/or such an oscillator and/or such a resonator mechanism.

The invention concerns the field of timepiece resonators and more particularly those that include elastic strips acting as return means for operation of the oscillator.

BACKGROUND OF THE INVENTION

The torsional stiffness of the suspension system is a difficult issue for most timepiece oscillators comprising at least one balance spring or elastic strips forming a flexure bearing, and particularly for resonators with crossed strips. And resistance to shocks also depends on this torsional stiffness; indeed, during out-of-plane impact, the stress experienced by the strips soon reaches very high values, which, accordingly, reduces the travel that the part can make before yielding. Shock absorbers for timepieces are available in many variants. However, their function, essentially, is to protect the fragile pivots of the arbor, and not the elastic elements, such as, conventionally, the balance spring.

European Patent Application No. EP3054357A1 in the name of ETA Manufacture Horlogère Suisse discloses a timepiece oscillator including a structure and distinct primary resonators, which are temporally and geometrically offset, each comprising a mass returned towards the structure by an elastic return means. This oscillator includes coupling means for the interaction between the primary resonators, including driving means for driving motion of a wheel set which includes driving and guiding means arranged to drive and guide a control means articulated to transmission means, each articulated, at a distance from the control means, to a mass of a primary resonator. The primary resonators and wheel set are arranged such that the articulation axes of any two primary resonators and the articulation axis of the control means are never coplanar.

European Patent Application EP3035127A1 in the name of SWATCH GROUP RESEARCH & DEVELOPMENT Ltd discloses a timepiece oscillator comprising a resonator formed by a tuning fork, which includes at least two mobile oscillating parts, fixed to a connection element by flexible elements whose geometry determines a virtual pivot axis of determined position with respect to a plate, and about which oscillates the respective mobile part, whose centre of mass coincides in the rest position with the respective virtual pivot axis.

For at least one moving part, the flexible elements are formed of elastic strips crossed at a distance from each other in two parallel planes, and whose directions, in projection onto one of the parallel planes, intersect at said virtual pivot axis of the moving part.

New mechanism structures make it possible to maximise the resonator quality factor, through the use of a flexure bearing using a lever escapement having a very small angle of lift, according to Swiss Patent Application No CH01544/16 in the name of ETA Manufacture Horlogère Suisse and derivative patents, whose teaching can be directly used in the present invention, and whose resonator can be further improved as regards its shock sensitivity, in certain particular directions. It is thus a matter of protecting the strips from breakage in the event of impact. It is clear that the anti-shock systems so far proposed for resonators with flexure bearings only protect the strips from impact in certain directions, but not in all directions, or that they have the drawback of letting the point of attachment of the flexure pivot move slightly during its oscillatory rotation, which should be avoided as far as possible.

Swiss Patent Application No. CH00518/18 or European Patent Application No. EP18168765.8 in the name of ETA Manufacture Horlogère Suisse discloses a timepiece resonator mechanism comprising a structure carrying, via a flexible suspension system, an anchor unit to which is suspended an inertia element oscillating in a first rotational degree of freedom RZ, under the action of return forces exerted by a flexure pivot comprising first elastic strips each fixed to said inertia element and to said anchor unit, the flexible suspension system being arranged to allow the anchor unit some mobility in every degree of freedom except the first rotational degree of freedom RZ in which only the inertia element can move to avoid any disruption to its oscillation, and the stiffness of the suspension system in the first rotational degree of freedom RZ is very considerably higher than the stiffness of the flexure pivot in this same rotational degree of freedom RZ.

SUMMARY OF THE INVENTION

The invention proposes to optimise the torsional stiffness of the suspension system, particularly for a resonator mechanism according to Patent Application No. CH00518/18 or EP18168765.8 in the name of ETA Manufacture Horlogère Suisse, or for a similar resonator with flexure bearings.

Improving the torsional stiffness of the suspension system also improves the protection of the strips against breakage in the event of shocks. A good rotary resonator with flexure bearings, which forms a flexure pivot and defines a virtual pivot axis, must be both very flexible for oscillatory rotation in a first rotational degree of freedom RZ, but also very stiff in the other degrees of freedom (X, Y, Z, RX, RY) in order to avoid undesired motions of the centre of mass of the resonator. Indeed, such undesired motions can cause errors of rate, if the orientation of the resonator changes in the field of gravity (referred to as 'position error'). The suspension of the attachment point of the pivot must be very stiff in the oscillatory degree of freedom, to avoid disturbing the isochronism of the resonator, and to avoid dissipating energy in motions due to reaction forces.

The invention proposes better control of the torsional stiffness of the suspension system to limit the out-of-plane displacements of the strips of a strip resonator, and thus to ensure improved resistance of the system, To this end, the invention concerns a strip resonator mechanism according to claim 1.

The invention also concerns a timepiece oscillator including at least one such resonator mechanism.

The invention also concerns a timepiece movement including at least one such resonator mechanism.

The invention further concerns a watch including such a timepiece movement and/or a such a resonator mechanism.

BRIEF DESCRIPTION OF THE DRAWINGS

Other features and advantages of the invention will appear upon reading the following detailed description with reference to the annexed drawings, in which.

DETAILED DESCRIPTION OF PREFERRED EMBODIMENTS

Figure 1:
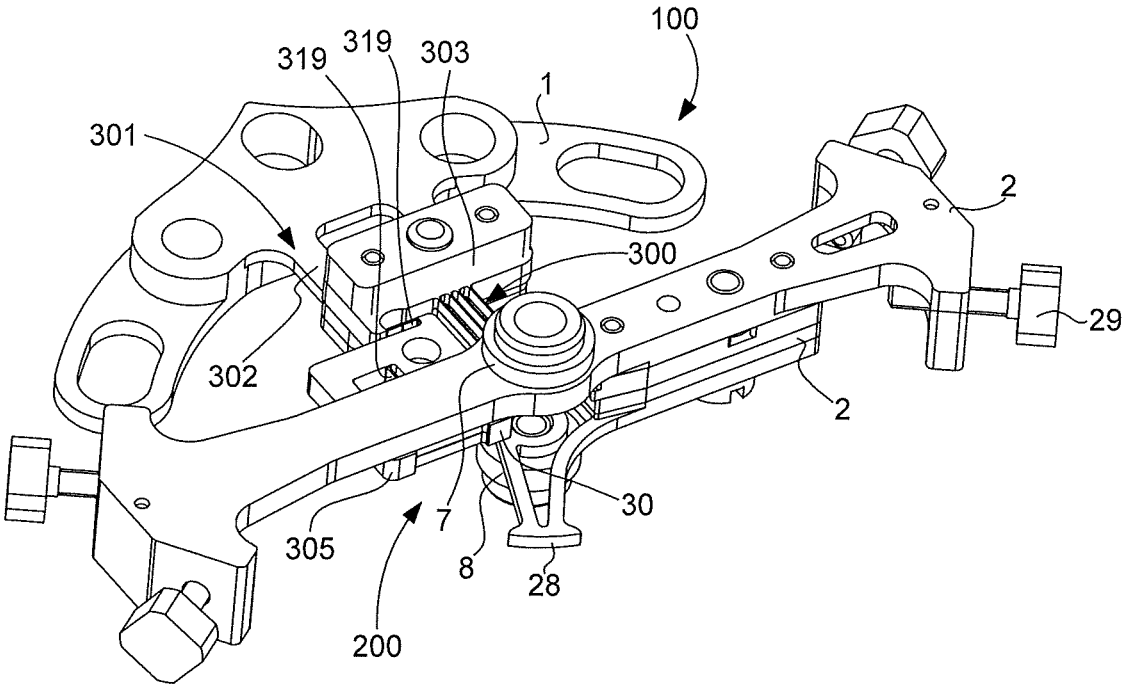
FIG. 1 represents a schematic plan view of a resonator mechanism with elastic strips, comprising an inertia mass suspended to an anchor unit by a flexure pivot comprising two parallel levels of elastic strips, wherein the directions in which these strips extend cross, in projection, at a virtual pivot axis of this inertia element, in accordance with Patent Application No. CH00518/18 or EP18168765.8 in the name of ETA Manufacture Horlogère Suisse, the teaching of which can be used in the context of the present invention; this resonator mechanism is represented in a particular, non-limiting configuration, wherein it includes two translation tables arranged to allow restricted freedom to intermediate masses comprised in the resonator between the anchor unit and the point of attachment to a plate; it is noted that each of these translation tables includes elongate elastic elements whose direction is substantially directed towards the pivot axis at a virtual pivot defined by the elastic strips; the inertia element here carries an inertia mass in the form of a balance with inertia adjustment screws, and also carries a protruding element, of the pin or similar type, arranged to cooperate with an escapement mechanism (not represented), and particularly with pallets, or directly with an escape wheel: this mechanism further includes upper and lower stop members to limit the travel of the inertia mass and to protect the flexure bearing strips.

The invention concerns a timepiece resonator mechanism, which forms a variant of the resonators disclosed in Patent Application Nos. CH00518/18 and EP18168765.8 in the name of ETA Manufacture Horlogère, which are incorporated herein by reference, and whose features will be able to be combined with the features of the present invention by those skilled in the art.

This timepiece resonator mechanism 100 comprises a structure 1 and an anchor unit 30 to which is suspended at least one inertia element 2 arranged to oscillate in a first rotational degree of freedom RZ about a pivot axis D extending in a first direction Z. Inertia element 2 is subjected to return forces exerted by a flexure pivot 200 comprising a plurality of substantially longitudinal elastic strips 3, each fixed, at a first end to anchor unit 30, and at a second end to inertia element 2. Each elastic strip 3 is deformable essentially in a plane XY perpendicular to first direction Z.

According to the invention, anchor unit 30 is suspended to structure 1 by a flexible suspension system 300, which is arranged to allow anchor unit 30 mobility in five flexible degrees of freedom of the suspension system, which are:

- a first translational degree of freedom in first direction Z,
- a second translational degree of freedom in a second direction X orthogonal to first direction Z,
- a third translational degree of freedom in a third direction Y orthogonal to second direction X and to first direction Z,
- a second rotational degree of freedom RX about an axis extending in second direction X,
- and a third rotational degree of freedom RY about an axis extending in third direction Y.

The principle of the invention is to use the torsional flexibility of a translation table to better control the torsional stiffness of the suspension system. To achieve this, the strips of tables XY are oriented such that the direction of greatest torsional flexibility is directed towards the axis of rotation of the resonator. The torsional flexibility of the strips is controlled by moving them closer to one another.

Thus, according to the invention, flexible suspension system 300 includes, between anchor unit 30 and a first intermediate mass 303, which is fixed to structure 1 directly or via a plate 301 that is flexible in first direction Z, a transverse translation table 32 with a flexure bearing, and which includes transverse strips 320 or transverse flexible shafts 1320, which are rectilinear and extend in second direction X and symmetrically around a transverse axis D2 crossing pivot axis D.

In a particular non-limiting embodiment, and as illustrated by the Figures, flexible suspension system 300 also includes, between anchor unit 30 and a second intermediate mass 305, a longitudinal translation table 31 with a flexure bearing, and which includes longitudinal strips 301 or longitudinal flexible shafts 1310, which are rectilinear and extend in third direction Y and symmetrically about a longitudinal axis D1 crossing pivot axis D. And, between second intermediate mass 305 and first intermediate mass 303, transverse translation table 32 with a flexure bearing includes transverse strips 320 or transverse flexible shafts 1320, which are rectilinear and extend in second direction X and symmetrically about transverse axis D2 crossing pivot axis D.

More particularly, longitudinal axis D1 crosses transverse axis D2, and in particular longitudinal axis D1, transverse axis D2 and pivot axis D are concurrent.

More particularly, longitudinal translation table 31 and transverse translation table 32 each include at least two flexible strips or shafts, each strip or shaft being characterized by its thickness in second direction X when the strip or shaft extends in third direction Y or conversely, by its height in first direction Z, and by its length in the direction in which the strip or shaft extends, the length being at least five times greater than the height, the height being at least as great as the thickness, and more particularly at least five times greater than said thickness, and more particularly still at least seven times greater than said thickness.

Figure 2:
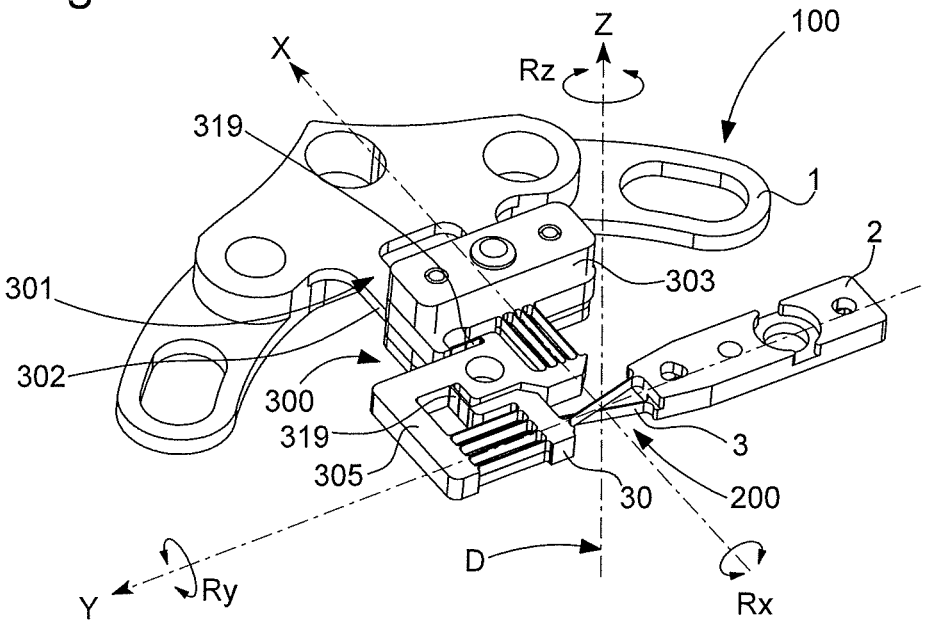
FIG. 2 shows a schematic, perspective view of the various degrees of freedom of the inertia mass comprised in the resonator mechanism of FIG. 1; the balance is removed to reveal the flexure bearing with the two elastic strips which cross in projection, and the two translation tables; the mechanism is represented in a configuration wherein at least one of the two levels of elastic strips belongs to a one-piece assembly, which includes breakable elements to make it easier to place the resonator mechanism in a movement before releasing it by breaking the breakable elements; more particularly, the two levels together can also form such a one-piece assembly.
Figure 3:
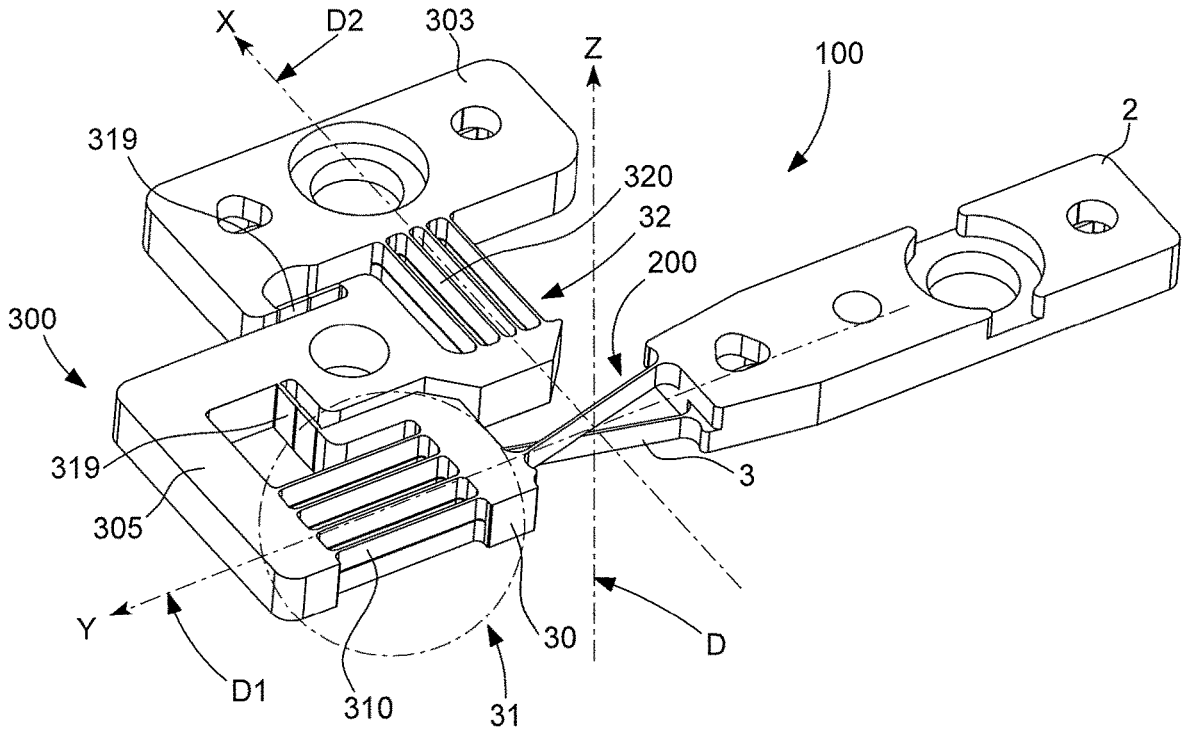
FIG. 3 represents, in a similar manner to FIG. 2, the same mechanism after removal of the elements for connection to a fixed structure of the watch.
Figure 4:
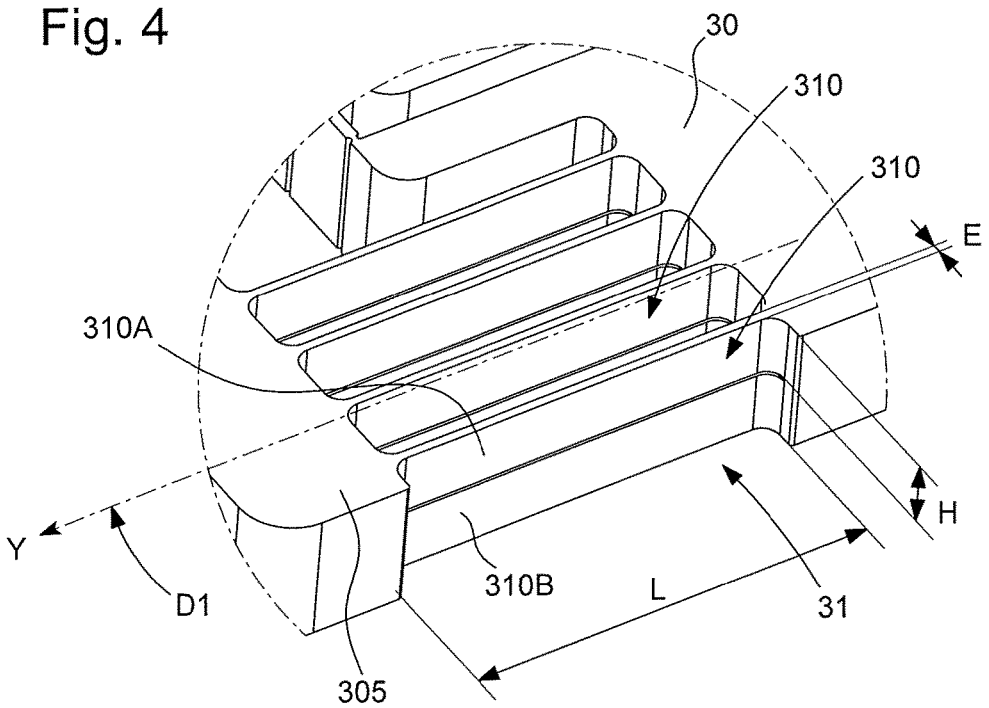
FIG. 4 represents, in a similar manner to FIG. 3, a detail of FIG. 3 showing a transverse translation table with rectilinear transverse elastic strips, on two superposed and parallel levels.
Figure 5:
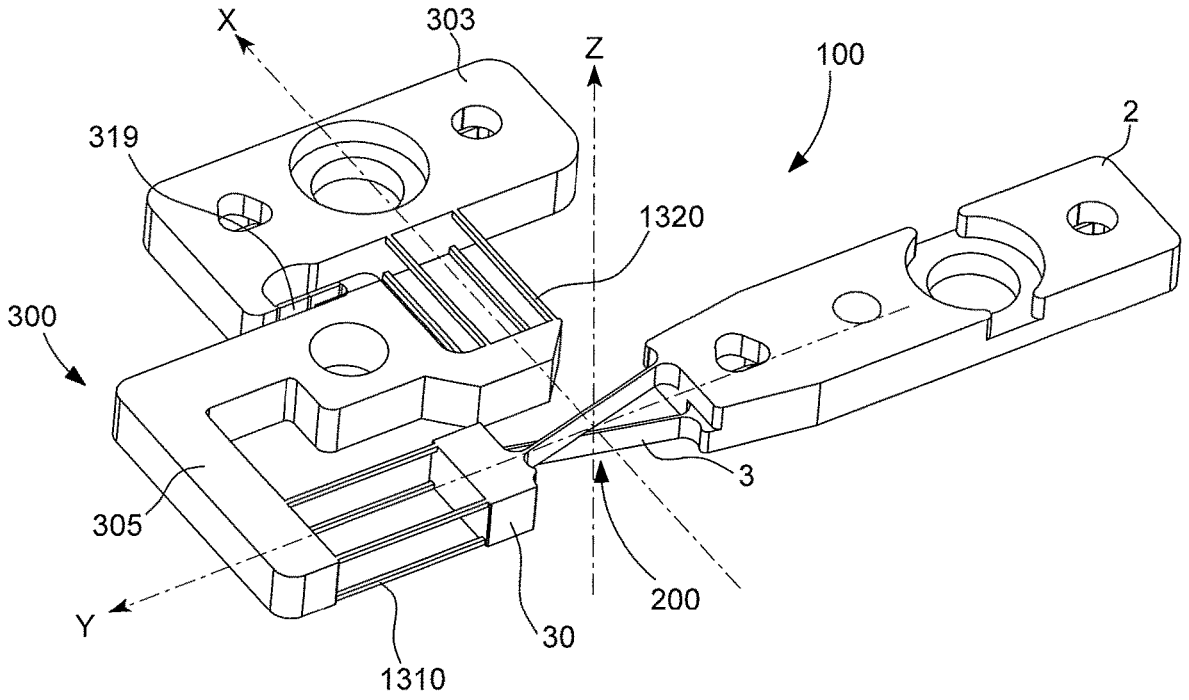
FIG. 5 represents, in a similar manner to FIG. 3, a similar mechanism, but wherein the translation tables include rectilinear flexible shafts of substantially square cross-section.
Figure 6:
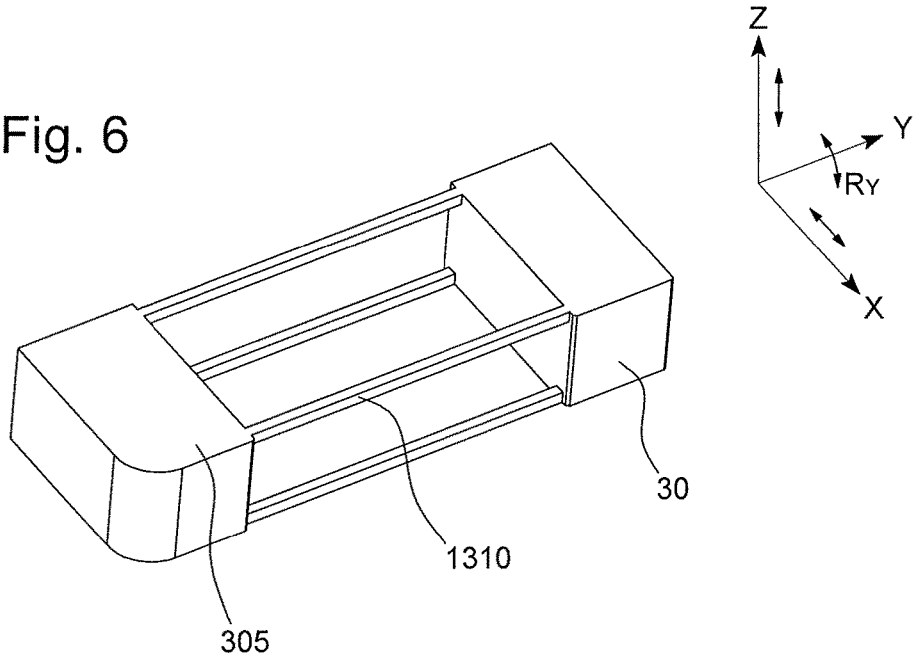
FIG. 6 is a detail of the rectilinear flexible shafts of substantially square cross section of FIG. 5.
Figure 7:
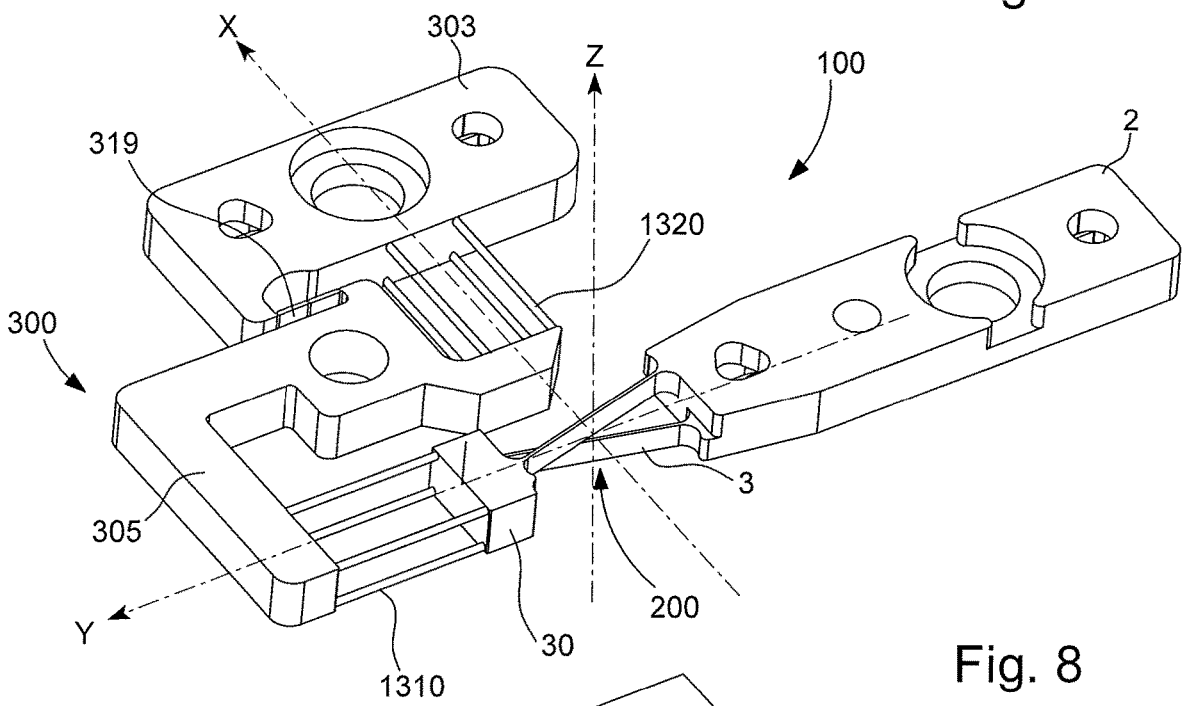
FIG. 7 represents, in a similar manner to FIG. 3, a similar mechanism but wherein the translation tables include rectilinear flexible shafts of substantially circular cross section.
Figure 8:
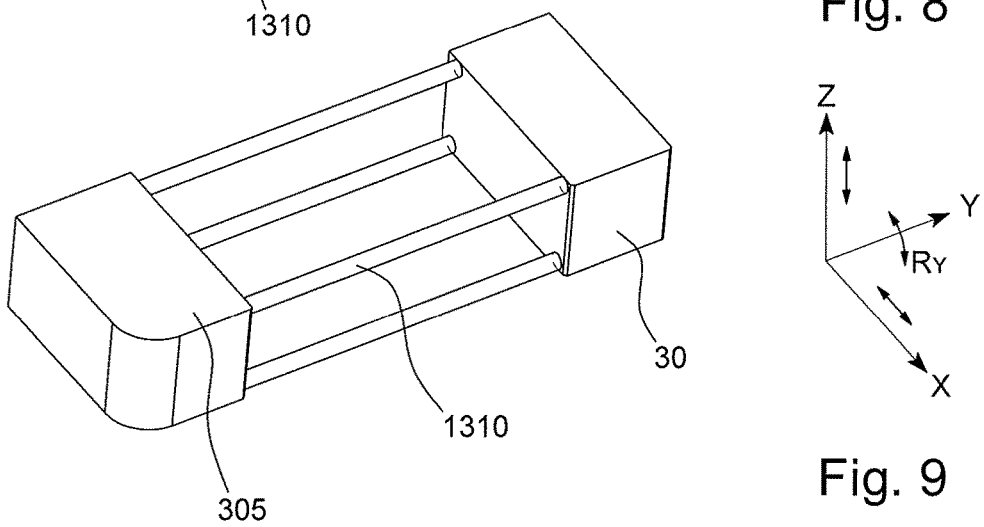
FIG. 8 is a detail of the rectilinear flexible shafts of substantially circular cross section of FIG. 7.
Figure 9:
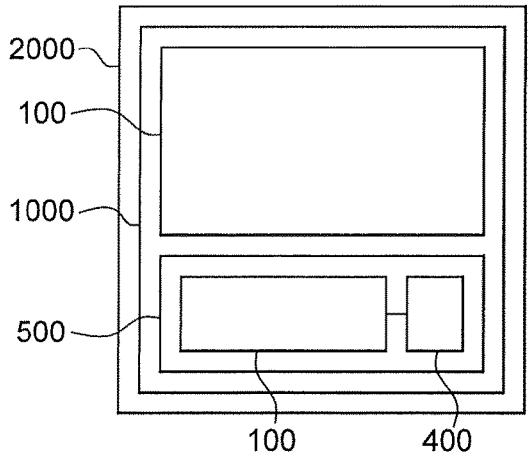
FIG. 9 is a block diagram representing a watch comprising a movement including, on the one hand one such resonator mechanism, and on the other hand an oscillator mechanism comprising one such resonator mechanism.

More particularly, transverse translation table 32 includes at least two transverse flexible strips or shafts, parallel to each other and of the same length. FIGS. 1 to 4 illustrate a non-limiting variant with four parallel transverse strips and, more particularly, each formed of two half-strips arranged on two superposed levels and extending in the extension of one another in first direction Z. These half-strips may be either entirely free with respect to each other, or joined by adhesive bonding or similar, or by $SiO_2$ growth in the case of a silicon embodiment, or similar. Naturally, longitudinal translation table 31 (when there is one since it is optional) may obey the same design principle. FIGS. 5 to 8 illustrate variants with flexible shafts, grouped in two levels of two shafts, of substantially square cross-section in FIGS. 5 and 6, or substantially circular in FIGS. 7 and 8. The number, arrangement and cross-section of these strips or shafts may vary without departing from the present invention.

More particularly, the transverse strips or shafts of transverse translation table 32 have a first plane of symmetry, which is parallel to transverse axis D2, and which passes through pivot axis D.

More particularly, the transverse strips or shafts of transverse translation table 32 have a second plane of symmetry, which is parallel to transverse axis D2 and orthogonal to pivot axis D.

More particularly, the transverse strips or shafts of transverse translation table 32 have a third plane of symmetry, which is perpendicular to transverse axis D2 and parallel to pivot axis D.

More particularly, the transverse strips or shafts of transverse translation table 32 extend over at least two parallel levels, each level being perpendicular to pivot axis D.

More particularly, the arrangement of the transverse strips or shafts of transverse translation table 32 is identical on each of the levels.

More particularly, the rectilinear transverse strips or flexible shafts 320, 1320 are flat strips whose height is at least five times greater than their thickness.

More particularly, 1 to 11, the rectilinear transverse strips or flexible shafts 320, 1320 are shafts of square or circular cross-section whose height is equal to their thickness.

More particularly, longitudinal translation table 31 includes at least two longitudinal flexible strips or shafts, parallel to each other and of the same length.

More particularly, the longitudinal strips or shafts of longitudinal translation table 31 have a first plane of symmetry, which is parallel to longitudinal axis D1, and which passes through pivot axis D.

More particularly, the longitudinal strips or shafts of longitudinal translation table 31 have a second plane of symmetry, which is parallel to longitudinal axis D1 and orthogonal to pivot axis D.

More particularly, the longitudinal strips or shafts of longitudinal translation table 31 have a third plane of symmetry, which is perpendicular to longitudinal axis D1 and parallel to pivot axis D.

More particularly, the transverse strips or shafts of longitudinal translation table 31 extend over at least two parallel levels, each level being perpendicular to pivot axis D.

More particularly, the arrangement of the transverse strips or shafts of longitudinal translation table 31 is identical on each of the levels.

More particularly, the longitudinal strips or rectilinear flexible shafts 310, 1310, are flat strips whose height is at least five times greater than their thickness.

More particularly, the longitudinal strips or rectilinear flexible strips 310, 1310 are shafts of square or circular cross-section whose height is equal to their thickness.

In particular, resonator mechanism 100 includes axial stop means, which include at least a first axial stop 7 and a second axial stop 8 for limiting the translational travel of inertia element 2, at least in first direction Z, the axial stop means being arranged to abuttingly engage with inertia element 2 for the protection of longitudinal strips 3 at least against axial impact in first direction Z, and the second plane of symmetry is substantially equidistant from first axial stop 7 and second axial stop 8.

In a particular variant, resonator mechanism 100 includes a plate 301, including at least one flexible strip 302 which extends in a plane perpendicular to pivot axis D and is fixed to structure 1 and to first intermediate mass 303, and which is arranged to allow first intermediate mass 303 mobility in first direction Z. More particularly, plate 301 includes at least two coplanar flexible strips 302. This plate 301 is, however, optional, if the height of the strips of translation tables XY is small with respect to the height of flexible strips 3, in particular less than a third of the height of flexible strips 3 and especially if these translation tables include flexible shafts 1310 or 1320 as in FIGS. 5 to 8.

In an advantageous embodiment, resonator mechanism 100 includes a one-piece assembly which contains at least anchor unit 30, a base of the at least one inertia element 2, flexure pivot 200, flexible suspension system 300, first intermediate mass 303, and transverse translation table 32, and includes at least one breakable element 319, which is arranged to secure the components of the one-piece assembly to each other during their assembly on structure 1, and the breaking of which releases all the movable components of the one-piece assembly.

More particularly, the one-piece assembly also includes at least second intermediate mass 305 and longitudinal translation table 31.

As explained above, the technology used for the manufacturing process allows two distinct strips to be obtained in the height of a silicon wafer, which promotes the torsional flexibility of the table without making it more flexible in translation. And resonator mechanism 100 can thus advantageously include at least two basic superposed one-piece assemblies, which each contain one level of anchor unit 30, and/or of a base of the at least one inertia element 2 and/or of flexure pivot 200, and/or of flexible suspension system 300, and/or of first intermediate mass 303, and/or of transverse translation table 32, and/or of a breakable element 319; each basic one-piece assembly can be assembled to at least one other basic one-piece assembly by adhesive bonding or similar, by mechanical assembly or by $SiO_2$ growth in the case of a silicon embodiment, or similar.

More particularly, such a basic one-piece assembly further includes at least one level of second intermediate mass 305 and/or of longitudinal translation table 31.

The invention also concerns a timepiece oscillator mechanism 500 including such a timepiece resonator mechanism 100 and an escapement mechanism 400, arranged to cooperate with one another.

The invention also concerns a timepiece movement 1000 including at least one such oscillator mechanism 500 and/or at least one such resonator mechanism 100.

The invention also concerns a watch 2000 including at least one such movement 1000, and/or at least one oscillator 500, and/or at least one such resonator mechanism 100.

The invention claimed is:

1. A timepiece resonator mechanism comprising:

a structure and an anchor unit to which is suspended at least one inertia element arranged to oscillate with a first rotational degree of freedom RZ about a pivot axis extending in a first direction Z, said inertia element being subjected to return forces exerted by a flexure pivot comprising a plurality of substantially longitudinal elastic strips, each fixed, at a first end to said anchor unit, and at a second end to said inertia element, each said elastic strip being deformable essentially in a plane XY perpendicular to said first direction Z, wherein said anchor unit is suspended to said structure by a flexible suspension system arranged to allow said anchor unit mobility in five flexible degrees of freedom of the suspension system, which are a first translational degree of freedom in said first direction Z, a second translational degree of freedom in a second direction X orthogonal to said first direction Z, a third translational degree of freedom in a third direction Y orthogonal to said second direction X and to said first direction Z, a second rotational degree of freedom RX about an axis extending in said second direction X, and a third rotational degree of freedom RY about an axis extending in said third direction Y, and wherein said flexible suspension system includes, between said anchor unit and a first intermediate mass, which is fixed to said structure directly or via a plate that is flexible in said first direction Z, a transverse translation table with a flexure bearing and including transverse strips or transverse flexible shafts which are rectilinear and extend in said second direction X and symmetrically around a transverse axis crossing said pivot axis.

2. The resonator mechanism according to claim 1, wherein said flexible suspension system comprises, between said anchor unit and a second intermediate mass, a longitudinal translation table with a flexure bearing and comprising longitudinal strips or longitudinal flexible shafts which are rectilinear and extend in said third direction Y symmetrically about a longitudinal axis crossing said pivot axis, and comprises said transverse translation table between said second intermediate mass and said first intermediate mass.

3. The resonator mechanism according to claim 2, wherein said longitudinal axis crosses said transverse axis.

4. The resonator mechanism according to claim 2, wherein said longitudinal translation table and said transverse translation table each comprise at least two said flexible strips or shafts, each said strip or shaft including a thickness thereof in said second direction X when said strip or shaft extends in said third direction Y or conversely, a height thereof in said first direction Z, and a length thereof in the direction in which said strip or shaft extends, said length being at least five times greater than said height and said height being at least as great as said thickness.

5. The resonator mechanism according to claim 2, wherein said longitudinal translation table includes at least two said longitudinal flexible strips or shafts, which are parallel to each other and of the same length.

6. The resonator mechanism according to claim 2, wherein said longitudinal strips or shafts of said longitudinal translation table have a first plane of symmetry parallel to said longitudinal axis and passing through said pivot axis, and/or a second plane of symmetry parallel to said longitudinal axis and orthogonal to said pivot axis, and/or a third plane of symmetry perpendicular to said longitudinal axis and parallel to said pivot axis.

7. The resonator mechanism according to claim 2, wherein said transverse strips or shafts of said longitudinal translation table extend over at least two parallel levels, each said level being perpendicular to said pivot axis.

8. The resonator mechanism according to claim 7, wherein the arrangement of said transverse strips or shafts of said longitudinal translation table is identical on each of said levels.

9. The resonator mechanism according to claim 2, wherein said longitudinal strips or rectilinear flexible shafts are flat strips whose height is at least five times greater than the thickness thereof, or shafts of square or circular cross-section whose height is equal to the thickness thereof.

10. The resonator mechanism according to claim 2, wherein said resonator mechanism includes a one-piece assembly, which contains at least said anchor unit, a base of said at least one inertia element, said flexure pivot, said flexible suspension system, said first intermediate mass and said transverse translation table, and includes at least one breakable element arranged to secure the components of said one-piece assembly to each other during assembly thereof on said structure, and the breaking of which releases all the movable components of said one-piece assembly, and wherein said one-piece assembly also includes at least said second intermediate mass and said longitudinal translation table.

11. The resonator mechanism according to claim 1, wherein said transverse translation table includes at least two said transverse flexible strips or shafts, which are parallel to each other and of the same length.

12. The resonator mechanism according to claim 1, wherein said transverse strips or shafts of said transverse translation table have a first plane of symmetry parallel to said transverse axis and passing through said pivot axis, and/or a second plane of symmetry parallel to said transverse axis and orthogonal to said pivot axis, and/or a third plane of symmetry perpendicular to said transverse axis and parallel to said pivot axis.

13. The resonator mechanism according to claim 1, wherein said transverse strips or shafts of said transverse translation table extend over at least two parallel levels, each said level being perpendicular to said pivot axis.

14. The resonator mechanism according to claim 13, wherein the arrangement of said transverse strips or shafts of said transverse translation table is identical on each of said levels.

15. The resonator mechanism according to claim 1, wherein said transverse strips or rectilinear flexible shafts are flat strips whose height is at least five times greater than the thickness thereof, or shafts of square or circular cross-section whose height is equal to the thickness thereof.

16. The resonator mechanism according to claim 1, wherein said resonator mechanism includes axial stop means including at least a first axial stop and a second axial stop to limit the translational travel of said inertia element at least in said first direction Z, said axial stop means being arranged to abuttingly engage with said inertia element for the protection of said longitudinal strips at least against axial impact in said first direction Z.

17. The resonator mechanism according to claim 1, wherein said resonator mechanism includes a plate comprising at least one flexible strip or a plurality of coplanar flexible strips, extending in a plane perpendicular to said pivot axis, said plate being fixed to said structure and to said first intermediate mass and arranged to allow said first intermediate mass mobility in said first direction Z.

18. The resonator mechanism according to claim 1, wherein said resonator mechanism includes a one-piece assembly, which contains at least said anchor unit, a base of said at least one inertia element, said flexure pivot, said flexible suspension system said first intermediate mass and said transverse translation table, and includes at least one breakable element arranged to secure the components of said one-piece assembly to each other during assembly thereof on said structure, and the breaking of which releases all the movable components of said one-piece assembly.

19. The resonator mechanism according to claim 1, wherein said resonator mechanism includes at least two superposed basic one-piece assemblies, which each contain one level of said anchor unit, and/or of a base of said at least one inertia element and/or of said flexure pivot, and/or of said flexible suspension system, and/or of said first intermediate mass, and/or of said transverse translation table, and/or of a breakable element.

20. A timepiece movement comprising:

at least one of the resonator mechanism according to claim 1, and/or at least one timepiece oscillator mechanism comprising the timepiece resonator mechanism and an escapement mechanism, which are arranged to cooperate with each other.

21. A watch comprising:

at least one of the movement according to claim 20.

* * * * *